United States Patent [19]

Chabanov et al.

[11] 4,214,464

[45] Jul. 29, 1980

[54] APPARATUS FOR CONTROLLING THE THICKNESS OF ROLLED PRODUCTS

[76] Inventors: Alim I. Chabanov, ulitsa Uritskogo, 12, kv. 73; Valery V. Daniljuk, ulitsa Revoljutsii, 6, kv. 46; Dzhavit K. Valeev, ulitsa Bljukhera, 20, kv. 26; Alfrid G. Bauer, ulitsa Petukhova, 46, kv. 73; Boris N. Petrov, ulitsa Deputatskaya, 26, kv. 16; Sergei N. Tropin, ulitsa Udarnaya, 1/2, kv. 52; Dmitry I. Chuguev, ulitsa Nemirovicha-Danchenko, 6, kv. 13; Ivan V. Ivanov, ulitsa Kostycheva, 8, kv. 7; Georgy A. Braun, ulitsa Nemirovicha-Danchenko, 135-b, kv. 68; Valery M. Alexandrov, Tsvetnoi prospekt, 7, kv. 41, all of Novosibirsk, U.S.S.R.

[21] Appl. No.: 973,732

[22] Filed: Dec. 28, 1978

[51] Int. Cl.[2] ..... B21B 37/02; B21B 37/08

[52] U.S. Cl. ..... 72/8; 72/16; 72/20; 72/245

[58] Field of Search ..... 72/8, 16, 9, 20, 21, 72/245

[56] References Cited

U.S. PATENT DOCUMENTS

| | | | |
|---|---|---|---|
| 3,416,341 | 12/1968 | Dey et al. | 72/21 X |
| 3,464,245 | 9/1969 | Dowsing et al. | 72/248 X |

*Primary Examiner*—Milton S. Mehr

*Attorney, Agent, or Firm*—Lackenbach, Lilling & Siegel

[57] ABSTRACT

There is provided hydraulically-operated work roll gap control cylinders forming a closed-circuit hydraulic system during rolling, and there are also provided hydraulically-operated backup roll control cylinders to which is connected a rolled product thickness gauge in order to keep constant the work roll gap depending on the pressure existing in the closed-circuit hydraulic system. The apparatus is provided with a hydraulic volume compensator operating in conjunction with the closed-circuit hydraulic system of work roll gap control and is also provided with a logic module connected to said compensator. The volume of fluid contained in the closed-circuit system changes in response to the corrective signal characteristic of a deviation of the strip thickness from the specified gauge. The passage of the signal to the hydraulic volume compensator is cleared or blocked by a special transportation lag unit.

4 Claims, 2 Drawing Figures

APPARATUS FOR CONTROLLING THE THICKNESS OF ROLLED PRODUCTS

BACKGROUND OF THE INVENTION

1. Field of the Invention

The present invention relates to rolling and more specifically, to apparatus for controlling the thickness of rolled products. It may be used as a means of automating sheet mills and drawbenches.

2. Description of the Prior Art

There is known in the art an apparatus for the automatic control of the thickness of rolled products in a mill stand wherein the strip thickness is controlled by means of screwdowns operating in response to the signals indicating the roll force and signals produced by a thickness gauge on the exit side of the stand. To obtain a high accuracy of control, employed in the known apparatus is a digital compensation by means of a thickness gauge consisting in that the signals generated during preceeding fine compensations are stored and added to the signals resulting from the subsequent fine compensations shaped depending on the signals indicating the deviations of the strip thickness from the setting with due allowance for the time lag which is the sum of the thickness gauge transportation lag and the control system delay.

Yet, prior art apparatus fails to assure high thickness accuracy all the way down the strip. This is, firstly, due to failures in the design which lacks a means of compensating for the disturbances originating at the mill stand proper and, secondly, because the apparatus introduces a static error while effecting the strip thickness control. Furthermore, the apparatus incorrectly reacts to the disturbances of non-uniformity occurring from time to time, particularly to those the period whereof is comparable with the transportation distance between the stand and thickness gauge, and fails to give stable performance at such rolling speeds when the frequency of roll wobble is less than, or equal to, the frequency of said disturbances.

Also conventional is an apparatus for strip thickness control capable of higher accuracies. Such apparatus incorporates hydraulically-operated work roll gap control cylinders forming a closed-circuit hydraulic system kept under a preset pressure during the rolling and a means of controlling the hydraulic force of setting the backup rolls in a quarto mill as a function of the fluctuations in the preset work roll gap registered by a differential pressure transducer sensing the changes in the pressure inside the closed-circuit hydraulic system of the work roll gap control for the sake of stabilizing said gap.

However, such apparatus fails to provide for an automatic adjustment of the mill so as to produce rolled products of a specified absolute thickness depending on the readings of an absolute thickness gauge at the exit side of the mill taken at the beginning of rolling. Said apparatus is also apt to react, causing a deterioration of the rolled product characteristics, to the disturbances occurring during the rolling and misinterpreted by the differential pressure transducer such as the heat expansion of rolls, wear on rolls and uncontrolled leaks from the closed-circuit hydraulic system.

SUMMARY OF THE PRESENT INVENTION

It is an object of the present invention to provide an apparatus for controlling the thickness of rolled product which assures high accuracy of the thickness all the way down the product rolled.

Another object of the present invention is to provide for automatic adjustment of the stands for rolling a product of specified gauge without introducing a static error.

A further object of the present invention is to cut the period of adjusting a stand for rolling a product of specified gauge.

Incorporated in the objects of the present invention, operational reliability of the apparatus as a whole.

The objects of the present invention are attained by an apparatus for controlling the thickness of rolled products incorporating hydraulically-operated work roll control gap cylinders forming a closed-circuit hydraulic system kept under a preset pressure during the rolling and a means of controlling the hydraulic force of setting the backup rolls as a function of the fluctuations in the preset work roll gap which are registered by a differential pressure transducer sensing the changes in the pressure inside the closed-circuit hydraulic system of work roll gap control—for the sake of stabilizing said gap—as well as a thickness gauge. The closed-circuit hydraulic system of work roll gap control is provided according to the invention with a hydraulic volume compensator and a logic module for the control of said compensator, which is connected thereto with its output and to the thickness gauge with its input and is arranged so as to produce an output signal depending on the amplitude of a corrective signal indicating the discrepancy between the actual rolled product thickness and the specified gauge—said output signal determining the degree of hydraulic volume compensation—, and there is also provided a thickness gauge transportation lag unit which is coupled to the logic module and serves to clear or block the passage of the corrective signal therefrom to the hydraulic volume compensator.

An advantage of an apparatus like the present invention is that it provides for maintaining the rolled product thickness very accurately within the specified limits.

In one embodiment of the invention the hydraulic volume compensator is a digital circuit consisting of two hydraulically-operated cylinders connected to the closed-circuit hydraulic system through servo valves controlled by the signals from the logic module, one of these cylinders serving to admit an additional volume of fluid into the closed-circuit hydraulic system and the other, to discharge fluid therefrom. The volume of fluid admitted into, or discharged from, the closed-circuit hydraulic system is constant for each of the cylinders and there is provided a means of operating the servo valves and cylinders at regular intervals so that during their repeated operations the volume of fluid is changed by the specified amount.

Incorporated into the logic module can be an analogue-to-number converter serving the purpose of converting the analogue signal produced due to a deviation of the strip thickness from the specified gauge into pulses the number whereof is equal to the additional inflows into, or outflows from, the closed-circuit hydraulic system in order to provide for the requisite hydraulic volume compensation.

An embodiment of the invention will now be described by way of an example with reference to the accompanying drawings in which:

DETAILED DESCRIPTION OF THE INVENTION

Figure 1:
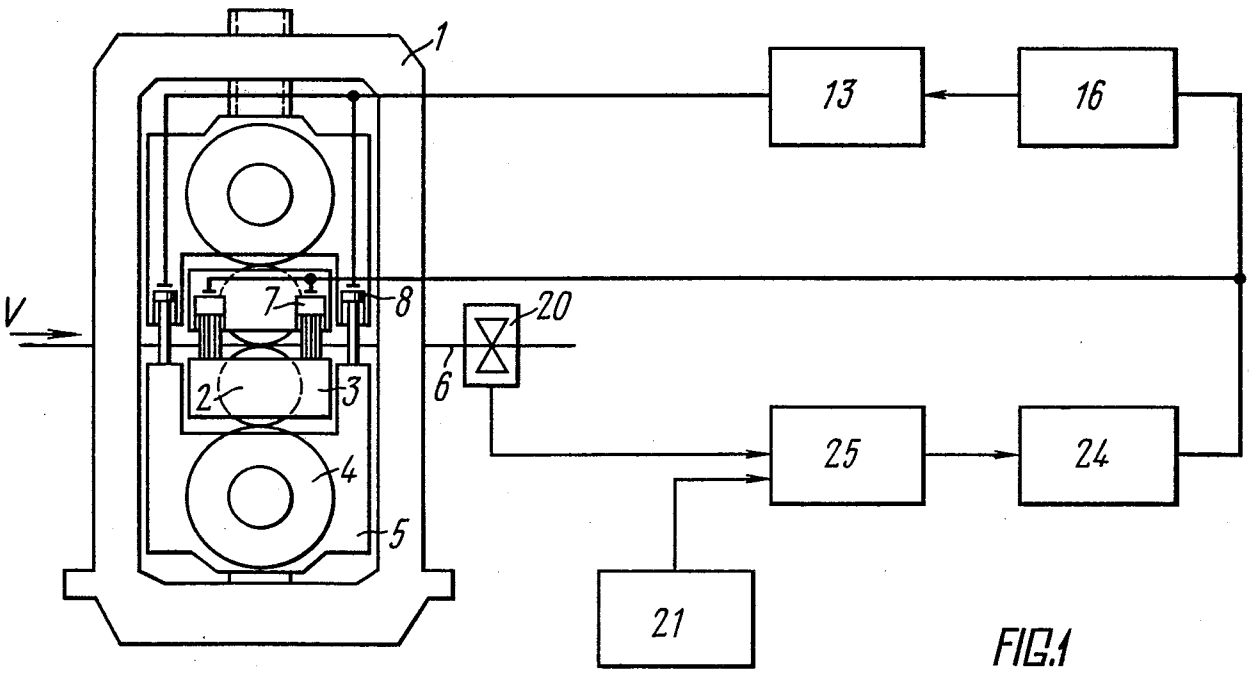
FIG. 1 is a block diagram of the apparatus in accordance with the invention along with a mill stand.

Illustrated in FIG. 1 is an apparatus for controlling the thickness of rolled product in a stand 1, the work and backup rolls 2 and 4, respectively, which are disposed in chocks 3 and 5, respectively. The rolling of a strip 6 is effected between the work rolls and the thickness of the strip 6 is governed by the gap of the work rolls 2. Said apparatus contains hydraulically-operated cylinders 7 controlling the gap of the work rolls 2, which are interposed between the chocks 3 of the work rolls 2, and hydraulically-operated cylinders 8 controlling the setting of the backup rolls 4, said cylinders being interposed between the chocks 5 of the backup rolls 4.

Figure 2:
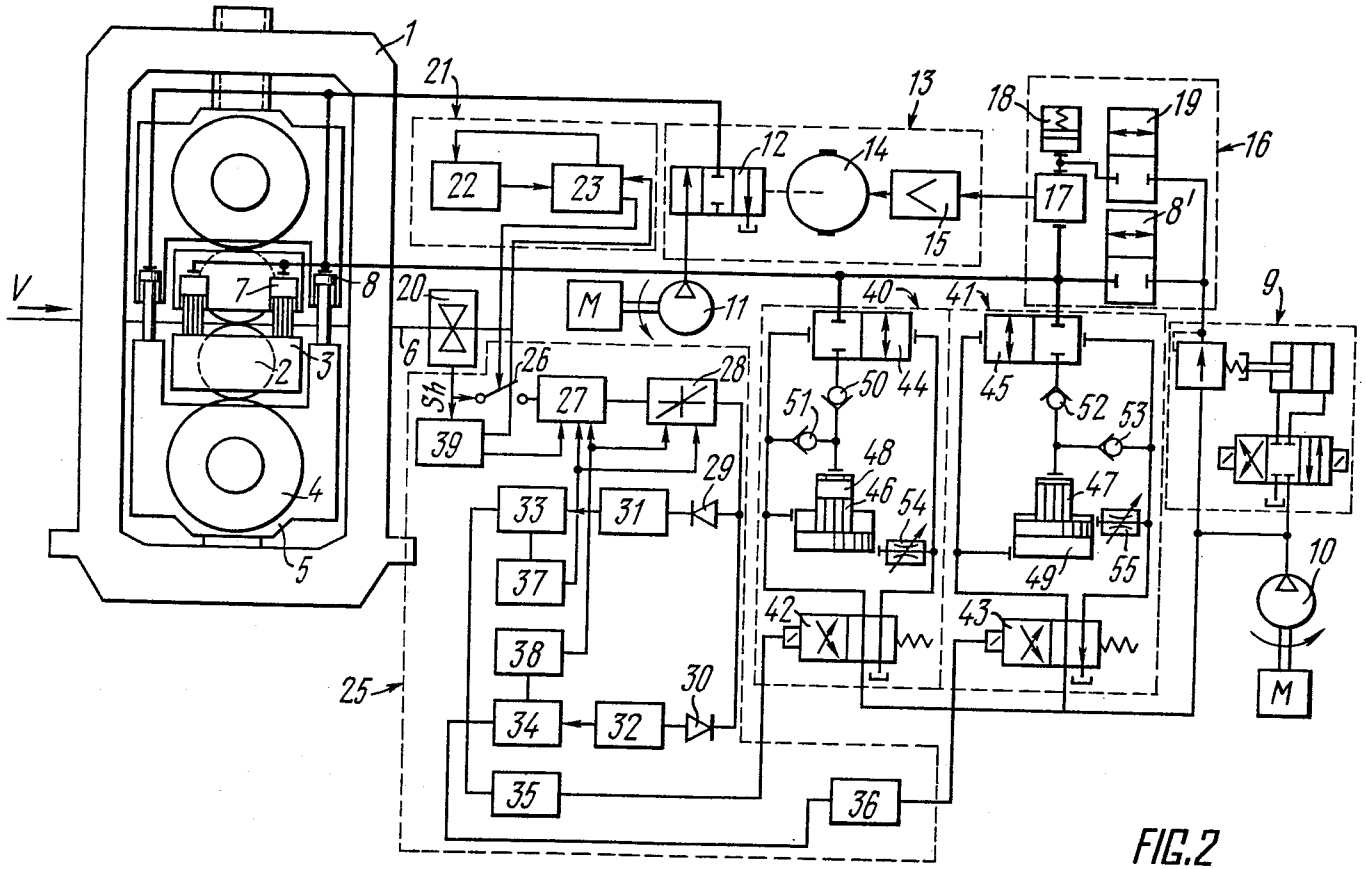
FIG. 2 is a circuit diagram of the apparatus shown in FIG. 1.

Referring to FIG. 2, the cylinders 7 are hydraulically coupled to a pump unit 10 through a stop valve 8' and a servo throttle valve 9. The cylinders 8 are also coupled to said pump unit through a servo valve (not shown) and to a high-pressure pump unit 11 by way of a rotary valve 12 which serves as an actuating mechanism of a strip thickness regulator 13. The rotary valve 12 is actuated with the aid of a low-inertia torque motor 14 controlled by a pulse modulation converter 15 controlled, in its turn, by the output voltage of a work roll gap sensor 16 which registers any work roll gap fluctuation by the displacement of the piston in a measuring cylinder 17 in response to a deviation of the pressure inside the closed-circuit hydraulic system from the preset value. To maintain the piston of the measuring cylinder about midlength thereof, use is made of a balancing cylinder 18 which is connected to the throttle valve 9 through a servo stop valve 19. The thickness of the strip 6 which is being rolled is determined with the aid of a thickness gauge 20.

The distance between the zone of deformation in the stand 1 and the thickness gauge 20 is determined by a transportation lag unit 21 in which is incorporated a pulse counter 22 fitted to the shaft of the main drive motor of the stand or to the deflecting roller in the case of a reversing mill (not shown) and a pulse counter command unit 23 which transmits the pulses from the pulse counter 22 into the circuit of the apparatus.

Catering for the compensation of the volume of fluid in the closed-circuit system of the work rolls is a hydraulic volume compensator 24. The degree of the hydraulic volume compensation and the sign thereof (the sign serves to indicate the direction of fluid flow between the hydraulic volume compensator and the closed-circuit hydraulic system) are controlled by a logic module 25 which also controls the passage of the corrective signal, indicating a deviation of the strip thickness from the preset gauge, between the thickness gauge 20 and the hydraulic volume compensator 24. The corrective signal $\sigma_{hi}$, referred to as the error, is fed into a memory circuit 27 through a controlled transistor switch 26, and the input of the memory circuit 27 is connected either to an analogue-to-number converter 31 or to an analogue-to-number converter 32, depending on the polarity of the corrective signal $\sigma_{hi}$, through an integrating amplifier 28 and a diode 29 or 30, respectively. The converters 31 and 32 serve to convert the analogue error signal $\sigma_{hi}$ into pulses the number whereof is strictly in proportion to the amplitude of the error. The pulses are shaped in signal conditioners 33 and 34 and amplified by means of power amplifiers 35 and 36. As soon as the last signal has passed, comparison circuits 37 and 38 clear the memory circuit 27, discharge the capacitance of the integrating amplifier 28 and retrigger the transportation lag unit 21. An integral part of the unit is a comparison circuit 39 the input of which is connected to the thickness gauge 20, one output is coupled to the transportation lag unit 21 and the other, to the memory circuit 27.

The hydraulic volume compensator 24 is connected to the closed-circuit hydraulic system of work roll gap control and is provided with two channels, an inflow channel 40 and an outflow one 41 controlled by the output signals from amplifiers 35 and 36, respectively. Incorporated into the inflow and outflow channels 40,41 are slide control valves 42 and 43 which serve to control the operation of servo valves 44 and 45 along with the position of pistons 46,47 of hydraulically-operated differential cylinders 48,49.

Non-return valves 50,51 and 52,53 as well as throttle valves 54,55 with controllable areas of passage provide a means of tuning the channels for the requisite performance.

The apparatus operates on the following lines. At the instant of resetting the mill the hydraulic systems of the work and backup rolls are at balance and the fluid fed by the pump unit 10 through the servo throttle valve 9 is admitted under a specified pressure, depending on the requisite chambering of the roll bodies, into the gap control cylinders 7,8 and the balancing cylinder 18 (the circuit of filling the hydraulic system of the backup roll is not shown in FIG. 2).

The roll gap resetting is effected with the aid of screwdowns set into motion from a mill remote control system (not shown in FIG. 2) or by the operator. The piston of the measuring cylinder 17 of the roll gap sensor 16 is caused, using an internal feedback channel, to move into its middle position. At the instant the rolling commences, the servo valves 8' and 12 close with the result that the pressures of the fluid in the gap control cylinders and the balancing cylinder 18 are the same. The hydraulic system of work roll gap control, closed by the servo valve 8', becomes "rigid" to an extent which depends on the parameters of the system and rolls. Any change in the temperature of the metal rolled, strip thickness, backup roll wobble, etc., i.e., any internal or external disturbance causes the work roll gap to deviate from the present dimension with the result that, by analogy with communicating vessels, the piston of the measuring cylinder leaves the middle position and moves either one way or another so as to come abutting against the cylinder end plate. The piston displacement is registered by a measuring device and, consequently, a signal of certain amplitude and polarity appears at the output from the work roll gap sensor. So, a narrowing of the work roll gap brings about an output signal at the sensor 16 of a polarity which causes the low-inertia torque motor 14 to move the plunger of the rotary valve 12 into a position admitting compressed fluid from the high-pressure pump unit 11 into the cylinders 8 which move the backup rolls some distance further apart. The mill stand deformation consequently increases and the work roll gap gets stabilized. Thus, the deviation of the strip thickness from the specified gauge is compensated for the piston of the indicating cylinder returns into its neutral position, and the actuator of the rotary valve 12 returns the valve into its neutral (original) position over position feedback channel (not shown). When the work roll gap widens, the rotary valve 12 is set by its actuator so that the hydraulic system of backup roll control is connected to a drain pipe. The pressure in the cylinders 8 drops, the stand deformation decreases (as if the stand settles) and the work roll gap is restored to normal.

A corrective signal $\sigma_{hi}$ appearing at the outlet from the thickness gauge betrays a disturbed setting of rolling parameters in the mill at the beginning of rolling or disturbances in the form of heat expansion and wear of rolls, leaks from the closed-circuit hydraulic system, etc.

As soon as the corrective signal appears at the output from the thickness gauge 20, set into operation is the transportation lag network incorporating the command unit 23 and the pulse counter 22 fitted to the shaft of the main drive motor of the last stand (or to the deflecting rollers in the case of a reversing mill) and reading the length of the strip 6 rolled from the moment the rolling commences and to the moment whereat the strip length is equal to the distance between the zone of deformation and the thickness gauge, i.e., to the moment the deformed strip enters the zone wherein its thickness is being measured by the thickness gauge 20 when the command unit 23 produces a signal causing a short-time closure of the switch 26 (of the order of 0.01 s) and blocking the rereading of said distance.

The signal proportional to the deviation $\sigma_{hi}$ of the strip thickness from the specified gauge is fed into the logic module 25 wherein the analogue value of the error is converted into pulses the number whereof is strictly proportional to said deviation. In other words, the error $\sigma_{hi}$ is fed into the memory circuit 27, integrated in the integrating amplifier 28 with voltage unit feedback and is applied to the analogue-to-number converter 31: through the diode 29 or to the analogue-to-number converter 32 through the diode 30, depending on the polarity of the error, wherein the analogue signal is converted into a corresponding number of pulses. The duration of the pulses is controlled, depending on the actual capabilities of the hydrolic volume compensator for quick operation, in the signal conditioners 33,34 and the pulses are amplified in the amplifiers 35,36. The digital circuit of hydraulic volume compensation in the closed-circuit hydraulic system of stand prestressing, separated into the inflow channel 40 and the outflow channel 41, is controlled by the pulses shaped as indicated above so that when the error $\sigma_{hi}$ is negative the logic module 25 produces a signal conducive to admitting an additional volume of fluid into the closed-circuit hydraulic system through the inflow channel 40. An increase in the volume of the fluid contained in the hydraulic system of work roll control causes an increase in the pressure in said system with the result that the piston of the measuring cylinder 17 displaces upwards and the sensor 16 generates a signal of a polarity which initiates a pressure build-up in the backup roll control cylinders 8 and a consequent stand deformation to a level which restores the pressure of the fluid in the closed circuit hydraulic system to the original value. In other words, the thickness regulator compensates for the error resulting from the above disturbances without changing the energy level in the hydraulic system of work roll prestressing. As soon as the last pulse produced by the signal conditioner 33 has passed, the comparison circuit clears the memory circuit 27, discharges the capacitance in the integrating amplifier 28 and furnishes the unit 23 with a signal (not shown) setting the apparatus ready for the next cycle of operation.

If the thickness error $\sigma_{hi}$ is zero due to the thickness regulator being set to the requisite parameter, the apparatus withholds from full-programme operation owing to the presence of the comparison circuit 39. This circuit, as implied by the mode of its operation, monitors the error $\sigma_{hi}$, being permanently connected to the thickness gauge 20, and periodically retriggers the transportation lag unit 21 at intervals which are by far shorter than the transportation lag when no error is produced or sets the command unit 23 for further reading of the signals and clears the logic module for a next cycle of operation if the error is present.

Catering for quick operation of the apparatus is a special materialization of the digital circuit of hydraulic volume compensation wherein the inflow channel 40 and the outflow channel 41 are provided with control valves 42,43 which are actuated by means of the output signals from the amplifiers 35,36, respectively, and serve to control the servo valves 44,45 as well as the position of the pistons 46,47 of the differential cylinders 48,49. When the pulses produced by the logic module are fed into the inflow channel 40, regarded as the original position of the piston 46 in the differential cylinder 48 is the lowermost one. As soon as the solenoid (not shown) of the control valve 42 is energized, the valve opens and in instantaneous inrush of the fluid exposed to the control pressure (the flow rate is just a few cubic centimeters) causes the servo valve 44 to move into its left-most position. Fluid is also admitted, by way of another circuit and throttle valve 54 with metered cross-sectional area, into the bore of the differential cylinder 48, causing the movable piston 46 to displace into its topmost position. This causes a sharp pressure build-up in the space confined by the piston 46 and the non-return valve 50. Since the valve 50 is set to open under a pressure higher than the control one, an additional volume of fluid is admitted into the closed-circuit hydraulic system of the work rolls from the differential cylinder through the valve 50, i.e., a proportional inflow of fluid takes place.

When the solenoid of the control valve 42 is de-energized, a spring (not shown) returns the valve into the original position, the servo valve 44 snaps into the right-most position, the movable piston 46 of the differential cylinder 48 displaces into the lowermost position and fluid is admitted into the upper space of the cylinder 48 through the non-return valve 51 set to open under a low pressure. The next pulse fed from the amplifier 35 causes a repeated inflow of fluid. The throttle valve 54 provides for the operation of the servo valve 44 before the movable piston 46 of the differential cylinder 48 completes its full-way travel. The recourse to the cylinders 48,49 of the differential type paves the way to employing low control pressure irrespectively of the variations in the pressure in the hydraulic system of work roll control, and the use of the servo valves 44,45 allows uncontrolled leaks of fluid through the digital circuit of hydraulic volume compensation to be eliminated, i.e. adds to the tightness of said hydraulic system.

The above apparatus enables precision rolling of strip with a maximum length of its not measured portion at the head equal to the transportation distance from exit zone to the measurement zone under the conditions of practically lagless control.

We claim:

1. An apparatus for controlling the thickness of a product rolled on a mill including a working stand which is fitted with work and backup rolls, which comprises hydraulically-operated cylinders controlling said work rolls connected one to another so as to form a closed-circuit hydraulic system during rolling, hydraulically-operated cylinders controlling the backup rolls, a rolled product thickness regulator connected to the hydraulically-operated backup roll controlling cylinders so as to change the roll-setting force depending on the fluctuations of the work roll gap specified, a differential pressure transducer reacting to the changes in the pressure in the closed-circuit hydraulic system and producing a signal to change the roll-setting force so as to stabilize the work roll gap, a gauge measuring the thickness of rolled product on the exit side of the stand and producing signals which change the work roll gap depending on the signal amplitude, a hydraulic volume compensator serving to control the volume of fluid in the closed-circuit hydraulic system of work roll gap control, a logic module for the control of said compensator, which is connected thereto with its output and to the thickness gauge with one of the inputs and is arranged so as to produce an output signal depending on the amplitude of the corrective signal indicating a discrepancy between the actual thickness of the rolled product and the specified gauge, said output signal determining the degree of hydraulic volume compensation, a thickness gauge transportation lag unit which is coupled to the logic module and serves to clear or block the passage of the corrective signal therefrom to the hydraulic volume compensator.

2. The apparatus as in claim 1, wherein the hydraulic volume compensator is a digital circuit formed by two hydraulically-operated cylinders connected to the closed-circuit hydraulic system through servo valves and controlled by the output signals from the logic module, one of these hydraulically-operated cylinders serving to admit an additional volume of fluid into the closed-circuit hydraulic system and the other, to discharge fluid from the closed-circuit hydraulic system.

3. The apparatus as in claim 2, wherein the volume of fluid admitted into, or discharged from, the closed-circuit hydraulic system is constant for each of the cylinders and there is provided a means of operating the servo valves and cylinders at regular intervals so that during their repeated operations the volume of fluid is changed by the specified amount.

4. The apparatus as in claims 1 or 2, wherein incorporated into the logic module are analogue-to-number converters which convert the analogue signal produced due to a deviation of the thickness of rolled product from the specified gauge into pulses the number whereof is equal to the number of the additional inflows into, or outflows from, the closed-circuit hydraulic system which are required in order to provide for the requisite hydraulic volume compensation.

* * * * *